US011781828B1

(12) United States Patent
Terrell

(10) Patent No.: US 11,781,828 B1
(45) Date of Patent: Oct. 10, 2023

(54) FIREARM MAINTENANCE SYSTEM

(71) Applicant: Reliable Process and Machine Engineering, Escondido, CA (US)

(72) Inventor: Brian D. Terrell, Escondido, CA (US)

(73) Assignee: Impeccabarrel LLC, Escondido, CA (US)

( * ) Notice: Subject to any disclaimer, the term of this patent is extended or adjusted under 35 U.S.C. 154(b) by 0 days.

(21) Appl. No.: 17/891,500

(22) Filed: Aug. 19, 2022

(51) Int. Cl.
*F41A 29/02* (2006.01)
*F41A 29/04* (2006.01)

(52) U.S. Cl.
CPC ..... *F41A 29/02* (2013.01); *F41A 29/04* (2013.01)

(58) Field of Classification Search
CPC ..... F41A 13/04; F41A 29/00–04
USPC ..... 42/95
See application file for complete search history.

(56) References Cited

U.S. PATENT DOCUMENTS

| | | | | |
|---|---|---|---|---|
| 1,050,678 | A * | 1/1913 | Moreno | F41A 29/00 510/435 |
| 1,552,994 | A * | 9/1925 | Lindeman | F41A 29/00 222/545 |
| 4,045,900 | A | 9/1977 | Byer | |
| 4,404,979 | A | 9/1983 | Hobbs | |
| 4,710,280 | A * | 12/1987 | Brilmyer | C25F 7/00 205/717 |
| 5,202,523 | A * | 4/1993 | Grossman | F41A 29/00 134/1 |
| 5,743,040 | A | 4/1998 | Kennedy | |
| 5,775,020 | A | 7/1998 | Baird | |
| 5,815,975 | A | 10/1998 | Rambo et al. | |
| 6,023,873 | A | 2/2000 | Baird | |
| 6,701,657 | B1 | 3/2004 | Hudspeth | |
| 7,073,286 | B2 | 7/2006 | Paananen et al. | |
| 7,743,706 | B1 | 6/2010 | Lai | |
| 8,079,170 | B2 | 12/2011 | Loftin | |
| 9,200,861 | B1 | 12/2015 | Kim | |
| 10,837,731 | B2 | 11/2020 | An | |
| 2006/0277811 | A1 | 12/2006 | Peterson | |
| 2007/0240353 | A1 | 10/2007 | An | |
| 2019/0178606 | A1* | 6/2019 | Warren | F41B 11/68 |
| 2021/0063109 | A1* | 3/2021 | Begins | F41A 29/00 |

FOREIGN PATENT DOCUMENTS

| | | | | |
|---|---|---|---|---|
| WO | WO-2009150674 | A1 * | 12/2009 | F41A 29/00 |

* cited by examiner

*Primary Examiner* — Bret Hayes
(74) *Attorney, Agent, or Firm* — James M. Duncan; Scanlon Duncan LLP

(57) ABSTRACT

A firearm maintenance system may be utilized to clean, lubricate and protect a firearm. Embodiments of the invention provide for creating a sealed environment between the breech end and muzzle end of the barrel of the firearm and introducing a maintenance fluid into the sealed environment. The maintenance fluid may be circulated within the barrel in a closed circulation configuration by a pump. The maintenance fluid may be heated. An ultrasonic generator may be utilized to induce cavitation in the maintenance fluid to improve cleaning efficiency. Fluid flow sighting devices may be utilized to visibly monitor operation. Electronic means to monitor and safeguard the firearm maintenance system may also be employed.

18 Claims, 31 Drawing Sheets

FIREARM MAINTENANCE SYSTEM

BACKGROUND OF THE INVENTION

Firearms used for hunting, target shooting, training, law enforcement, and military purposes require proper maintenance to maintain firearm longevity, accuracy, and reliability. Proper maintenance includes the need to thoroughly clean and lubricate the barrel, bolt carrier group, and other moveable and stationary components of the firearm's action. In addition, firearms must be protected to prevent the formation of rust and corrosive byproducts from attacking the metallic parts of the firearm, as well as the non-metallic components where applicable. If a firearm is to be stored for an extended period of time, it may also be desirable to apply a preservative coating to the various components of the firearm to prevent rust formation and corrosion, and to extend its shelf stability and useful life, especially in high humidity environments.

Every time a firearm is discharged, carbon, lead, copper and plastic (where applicable) residue are left in the barrel, chamber and action from the powder, wad and bullets. Some ammunition includes corrosive salts in the primer which will result in damage if not adequately cleaned from the firearm. In addition, moisture from humidity and sweat can cause corrosion such as rust which will damage the firearm's metallic parts and foul others. An inadequately cleaned or uncleaned firearm can cause it to malfunction or adversely affect the firearm's performance such as accuracy and repeatability. In cleaning a firearm, the goal is to remove all foreign substances, residues, particulates or other foreign matter, while minimizing adverse effects to any applied finishes or firearm features. Such undesirable substances can include carbon fouling, dirt, debris, old oil and grease, as well as lead and copper residue.

Proper lubrication is a necessary component of firearm maintenance. The purpose of firearm lubrication is to reduce friction between moving parts of the firearm to reduce the frictional coefficient between the parts, to provide smooth operation and reduce the propensity for wear.

Firearm protection requires that the firearm have present a protective coating layer on exposed parts that are susceptible to surface corrosion or attack. Corrosion can start on an untreated surface exposed to the atmosphere for even a short duration of time. In some cases, an inert environment that is impervious to corrosive atmospheres may also be desired. For this reason, many firearms are received from the firearm manufacturer's factory with a coating of bluing, phosphate coating, anodizing, paint or other surface treatment. In some cases, protective substances like tacky grease may be applied to protect susceptible surfaces in anticipation of extended storage or in anticipation of adverse handling procedures. This grease and any residue must be completely removed from the firearm before it is subsequently used.

Cleaning, lubricating and protecting a firearm are historically done with separate applications of different products suitable for cleaning, lubricating and protecting. For purposes of this disclosure, cleaning, lubricating and protecting are all generally referred to as firearm maintenance, and embodiments of the present firearm maintenance system may be utilized in each of these steps of firearm maintenance.

The known devices utilized for cleaning firearms typically utilize cleaning rods or baths. The cleaning rods typically comprise multiple rod sections which are threadably attached in an end-to-end configuration. A bore brush and/or cleaning swab is attached to an end of the assembled rods and rammed through the barrel in a single or back and forth direction. However, every time a cleaning rod and attached tool are rammed through the bore of the firearm, a minute amount of metal is worn away, or the surface is damaged through the embedment of other free metals, carbon or contaminants. Repeated use of a dirty or improperly sized cleaning rod, or cleaning implements using incompatible materials can cause serious damage to the barrel bore surfaces damaging the firearm indefinitely. The known devices also result in a time consuming and laborious process to efficiently and reliably clean a firearm.

Lubricating a firearm includes the application of oil to the moving metal parts, fretting surfaces, as well as applying a thin layer of gun oil to the barrel bore or other parts. The known practice of lubricating the barrel is to apply the oil to a bore brush or swab and run the brush or swab through the barrel with an assembled gun cleaning rod as described above or to use a gross spray type device.

Applying a protective coating to the moving metal parts, fretting surfaces, bolt carrier group, gas tube and barrel of a firearm is generally done in the same manner as applying lubricant and similar devices may be utilized.

A device which efficiently cleans, lubricates and protects a firearm which does not require bore brushes, swabs, or other like foreign bodies is desirable.

SUMMARY OF THE INVENTION

Embodiments of the present invention provide a firearm maintenance system and method which may be utilized for cleaning, lubricating and protecting a firearm without causing undue damage, and in a non-laborious way.

The firearm maintenance system is utilized for maintaining a firearm having a barrel with a breech end and a muzzle end. Embodiments of the system may be utilized on rifles, pistols, shotguns, breechloading, and non-breechloading firearms. Embodiments of the invention may also be utilized on firearms having a muzzle device, such as a flash hider, muzzle brake, or compensator and may be used to maintain the muzzle device itself.

The system utilizes a breech plug which is configured to fit within and form a liquid tight seal with the breech end of the barrel. The system also has a muzzle seal which is configured to fit and form a liquid tight seal with the muzzle end of the barrel, including muzzle ends which have present muzzle devices, sights, exposed threads, outwardly protruding structures, or inwardly protruding surfaces such as rifling. In some embodiments the muzzle seal clamps around an exterior end of the barrel, while in other embodiments the barrel plug may be inserted into the muzzle end of the barrel, forming a liquid tight seal.

The system may have a pump comprising a housing having a suction side and a pressure side, the suction side having an inlet conduit and the pressure side having an outlet conduit. In operation of the system, the user introduces a desired volume of maintenance fluid into the hydraulically connected and configuration specific inlet or outlet conduit by squeeze bottle, syringe, or other maintenance fluid reservoir capable of providing a flow of maintenance fluid to the respective conduit or prefiling the barrel before installation of the system. In embodiments of the invention which use a centrifugal pump, the removal of air from the internal cavities can be an important troubleshooting step for proper pump operation, and manipulation of the barrel to facilitate pump prime is advantageous. It is to be noted that fluid introduction can made through the "inlet" or "outlet" with equivalent effect because in all embodiments all cavities are filled so that they are devoid of air.

The outlet conduit may be configured to extend through the muzzle seal thereby providing a flow of a maintenance fluid into the barrel. Flow into the barrel through the muzzle seal may be provided by a structure designated herein as a barrel plug, where the barrel plug has a first end which may receive a flow of maintenance fluid from the outlet conduit of the pump. The barrel plug further comprises a second end comprising one or more fluid outlets through which maintenance fluid flows into the barrel of the firearm. Once a volume of maintenance fluid has been received into the barrel of the firearm, the hydraulically connected inlet or outlet conduit may be closed from receiving any additional maintenance fluid, so that the maintenance fluid is pumped through the barrel of the firearm in a closed circulation system flowing from the outlet conduit of the pump, through the barrel plug into the barrel of the firearm and flowing back to the inlet conduit to the pump. In this configuration, a volume of maintenance fluid may be repeatedly pumped through the barrel of the firearm. Closure of the hydraulically connected inlet or outlet conduit to additional maintenance fluid may be accomplished by a valve or by closing a flow inlet to the inlet conduit.

Some embodiments of the invention may have a barrel tube having a first end attached to the inlet conduit and a second end configured to be inserted into the barrel and the end thereof placed adjacent to the breech plug. The outlet conduit may be hydraulically connected by the barrel plug to an annulus defined between an exterior of the barrel tube and an interior of the barrel. With this embodiment, flow may be directed into the annulus, with the flow entering the barrel tube at the second end flowing back to the inlet conduit. With the hydraulically connected inlet or outlet conduit in a closed configuration, closed circulation may be established with a continuing flow of a maintenance fluid in the annulus. A filter may be disposed at the second end of the barrel tube to collect material which has accumulated in the maintenance fluid.

In some embodiments the muzzle seal clamps around an exterior end of the barrel, while in other embodiments the muzzle seal may be inserted into the muzzle end of the barrel, forming a liquid tight seal. This latter embodiment includes an embodiment in which the barrel plug creates a liquid tight seal at the muzzle.

Some embodiments of the invention may include a fluid heater through which a maintenance fluid is directly or indirectly heated by the fluid heater. Such a heater in which the maintenance fluid is directed prior to flowing into the barrel. However, other embodiments may include a heater which applies heat from the outside of the barrel, or which apply heat at the breech end of the barrel.

A volume of maintenance fluid may be maintained in a maintenance fluid reservoir, such as a bottle or other suitable container, or other containment vessel hydraulically connected to the pump. The maintenance fluid reservoir may comprise a squeeze bottle which a user may squeeze to initiate flow into the inlet conduit, a syringe by which the user utilizes a plunger to initiate flow into the inlet conduit, or by virtue of a hydraulically connected reservoir. Once a sufficient volume of maintenance fluid has been delivered to the hydraulically connected inlet or outlet conduit, a valve or inlet port to the pump may be closed to form a closed circulation system separate from the fluid reservoir. Once the maintenance process has been completed, the valve or hydraulically connected inlet or outlet port may be opened for discharge of the maintenance fluid from the firearm and from the system for maintaining the firearm, or the barrel plug or muzzle seal, and pump removed, and the maintenance fluid poured directly out from the barrel and captured for reuse.

The muzzle seal may have a housing having a barrel attachment end, a pump housing attachment end, and an intermediate section there between. The housing may comprise an internal profile which has a decreasing diameter between the intermediate section and the barrel attachment end. The muzzle seal may further have a grommet disposed within the housing, where the grommet is configured to squeeze around the barrel as the grommet is urged toward the barrel attachment end.

The pump housing attachment end of the muzzle seal may be configured to engage a pump housing which contains the pump. The engagement of the pump housing to the pump housing attachment end of the muzzle seal urges the grommet toward the barrel attachment end, causing the grommet to squeeze around the barrel as the grommet is urged toward the barrel attachment end. The pump housing and the pump housing attachment end may have complementary threads which connect the pump housing to the pump housing attachment end, or by other mechanical means.

Embodiments of the invention may also have an ultrasonic generator which is configured to induce cavitation in the maintenance fluid in the barrel. Alternatively, flow induced cavitation in the barrel of the firearm may be induced by virtue of the internal hydraulics, flow geometry, pressure profile, manipulation of the maintenance fluid characteristics, utilization of a control valve in the pump inlet or outlet conduit or by use of a laser to name a few. While potentially harmful to some components, when used appropriately, induced cavitation bubbles are very effective at cleaning surfaces and hard to reach places.

Embodiments of the invention may utilize a centrifugal pump wherein an impeller is disposed within the pump housing. In this embodiment the pump housing may have a suction side and a pressure side. A motor shaft is connected to the impeller.

Embodiments of the invention may be automated to allow unmonitored maintenance of the firearm or provide for safety checks like overheating or over amperage. For example, an electronic controller may be utilized to start and/or stop the pump, motor, heater and ultrasonic generator. For example, following a day of hunting, an automated embodiment may allow the firearm to be cleaned while the user is preparing for another day hunting. The electronic controller may be accessible by a cell phone or remote application to allow remote operation of the maintenance system or provide for warnings of pending issues. Other feedback systems such as lights or sounds may be employed.

It is to be appreciated that a header system may be devised wherein a single pump, motor, maintenance fluid reservoir, heater and other components may be connected to several firearms, wherein a sealed environment has been formed in each barrel through the use of multiple breech plugs and muzzle seals.

BRIEF DESCRIPTION OF THE DRAWINGS

FIG. 15A shows a close-up view from FIG. 15 of the attachment of the muzzle seal and pump to the barrel of a firearm having a muzzle device.

DETAILED DESCRIPTION OF THE INVENTION

Figure 1:
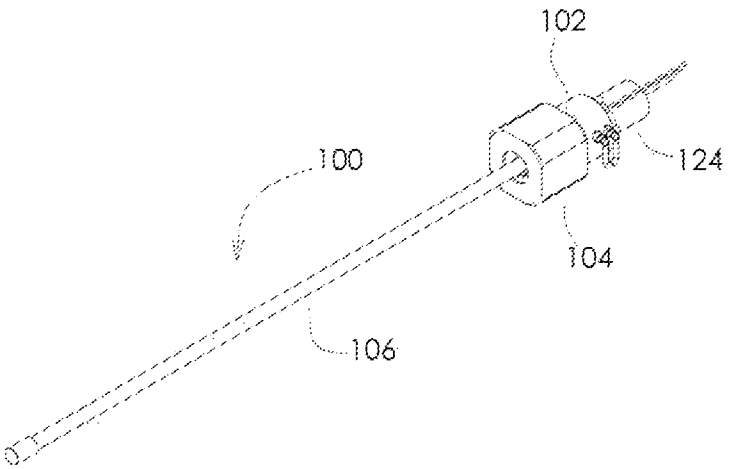
FIG. 1 depicts a perspective view of an embodiment of the firearm maintenance system comprising a pump, muzzle seal, and barrel tube, but not showing the breech plug.
Figure 2:
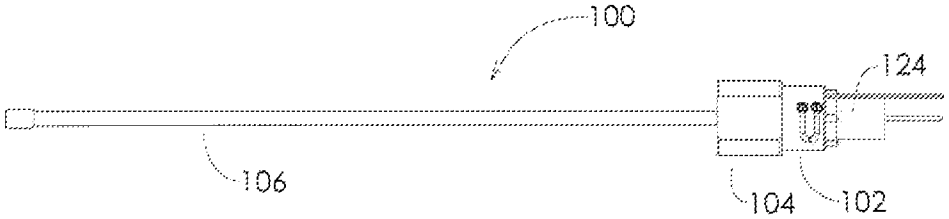
FIG. 2 depicts a top view of the system depicted in FIG. 1.
Figure 3:
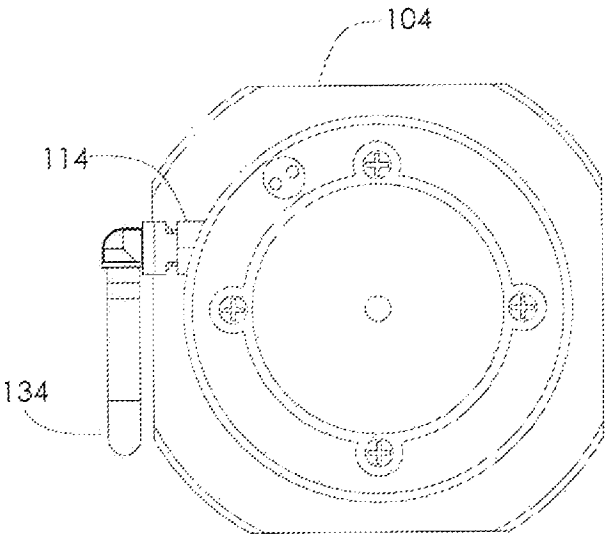
FIG. 3 depicts a rear view of the system depicted in FIG. 1.
Figure 4:
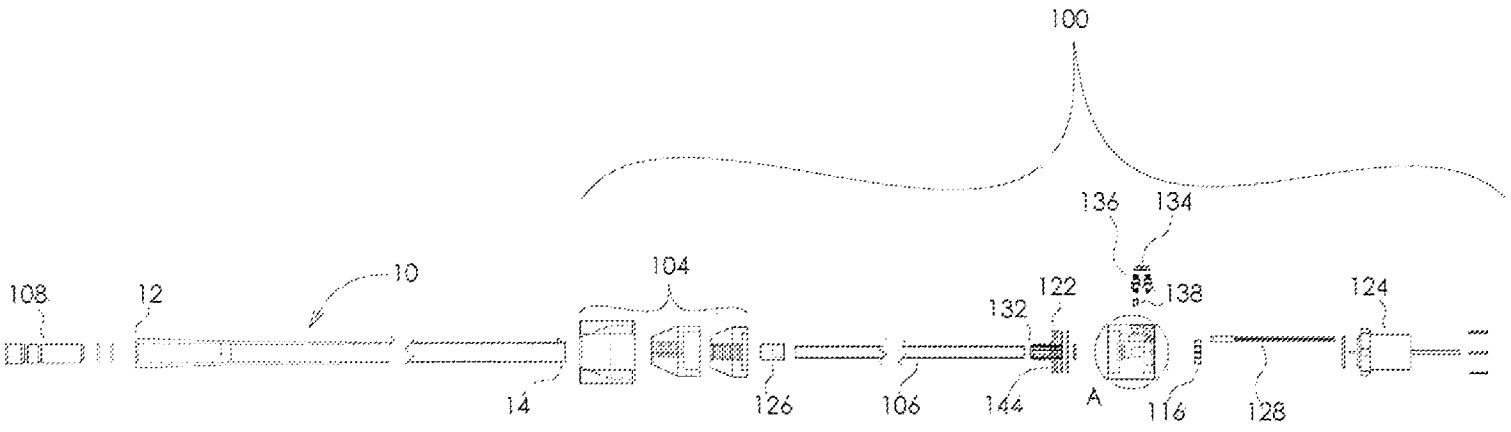
FIG. 4 depicts an exploded view of the system depicted in FIG. 1, also including a breech plug which is utilized with embodiments of the invention.

Referring now to the Figures, FIGS. 1-3 show an embodiment of a first embodiment of a firearm maintenance system 100, which system further comprises a breech plug 108 (not shown in FIGS. 1-3 but shown in FIG. 4). The first embodiment of the firearm cleaning system 100 comprises a pump 102, a muzzle seal 104 and may comprise an optional barrel tube 106.

Figure 4A:
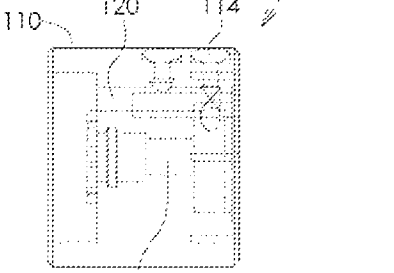
FIG. 4A depicts a detailed view of the structure encircled in FIG. 4.

FIGS. 4 and 4A show an exploded view of the firearm maintenance system 100 including breech plug 108 in relative position with a barrel 10 of a firearm, the barrel having a breech end 12 and a muzzle end 14. As further shown in FIG. 4 and FIG. 4A, pump 102 may comprise a housing 110 having a suction side 112 and a discharge side 114. Pump 102 may further comprise an impeller 116. A motor 124 may be attached to the rear of pump 102 with a motor shaft (not shown) configured to rotate impeller 116.

Flow from discharge side 114 may be routed through sight tube 134 before flowing into outlet conduit 120. A squeeze bottle, syringe, or other maintenance fluid reservoir may be connected to a port at swivel tube fitting 136 to provide an initial flow of maintenance fluid into the outlet conduit 120. Alternatively, fluid may be placed inside the barrel prior to installation of the firearm maintenance system 100. A check valve 138 may be utilized to prevent backflow of the maintenance fluid. Once a charge of maintenance fluid has been placed into the firearm maintenance system, the swivel tube fitting may be closed thereby forming a closed system. Fluid flow may be visually confirmed by flow through sight tube 134.

Outlet conduit 120 provides flow to barrel plug 122 which has flow channels (or conduits) 132. Barrel plug 122 extends into muzzle seal 104. A forward end 142 of barrel plug extends into the muzzle of barrel 10, where flow channels 132 extend through to the forward end 142. Barrel plug 122 has a rearward end having a flange 144 which may, but not necessarily, abut against the muzzle. Flange 144 may have an O-ring groove 146 to provide for sealing within pump housing 110. Barrel plug 122 provides a flow of maintenance fluid into barrel 10. The maintenance fluid flows to breech plug 108 which prevents flow of the maintenance fluid past the breech end 12 of the barrel 10.

As depicted in some figures including FIGS. 4 and 4A, a barrel tube 106 may be utilized with some embodiments of the system. If used, an end of barrel tube extends through an opening 140 of barrel plug 122, with the end disposed adjacent suction side 112. Flow channels 132 of barrel plug 122 are disposed around the exterior of barrel tube 106. When installed to a firearm, barrel tube 122 extends through barrel plug 122 into the barrel 10 of the firearm. Maintenance fluid flows through flow channels 132 and enters the annular space defined by the exterior of barrel tube 106 and the interior of barrel 10. The flow of maintenance fluid, blocked by breech plug 108, U-turns and enters the end of barrel tube 106 adjacent the breech plug. The maintenance fluid may be filtered by barrel tube filter 126 attached at the end of the barrel tube 106.

Figure 5:
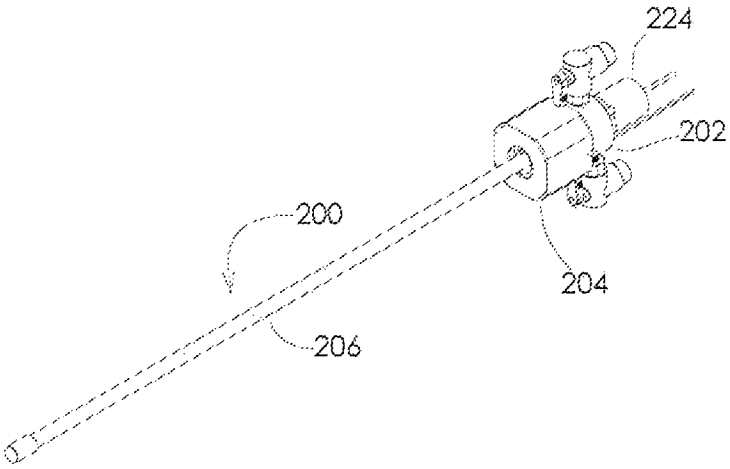
FIG. 5 depicts a perspective view of an alternative embodiment of the firearm maintenance system comprising a pump, muzzle seal, and barrel tube utilized in embodiments of the invention but not showing the breech plug.
Figure 6:
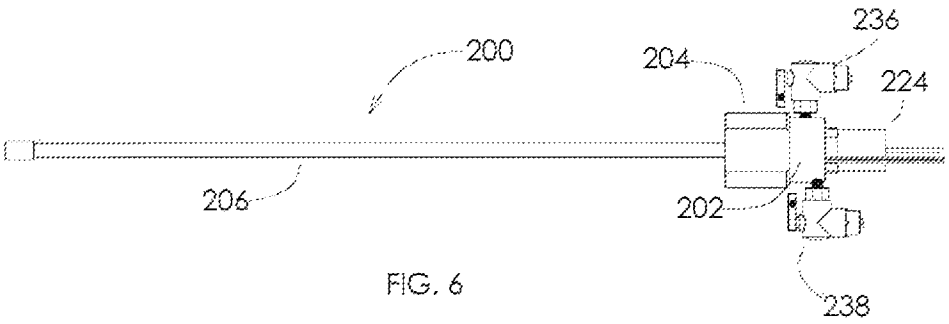
FIG. 6 depicts a top view of the system depicted in FIG. 5.
Figure 7:
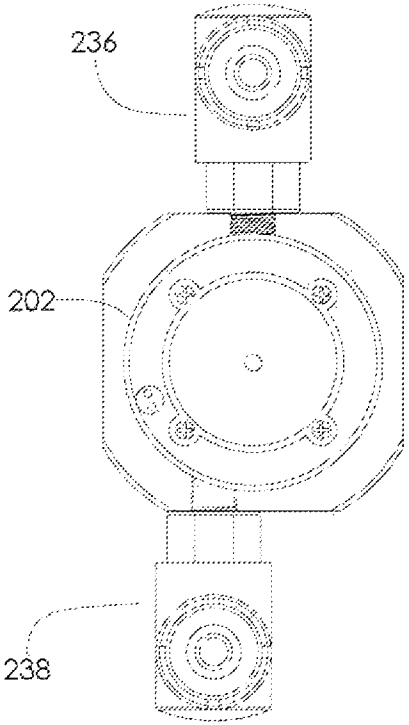
FIG. 7 depicts a rear view of the system depicted in FIG. 5.
Figure 8:
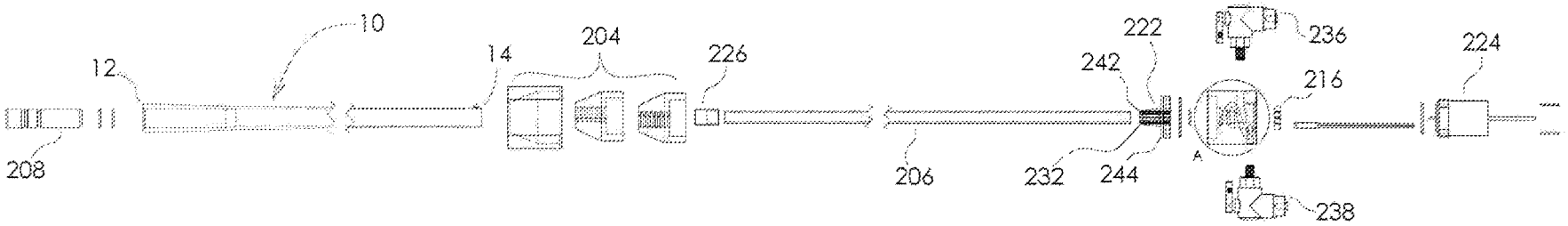
FIG. 8 depicts an exploded view of the system depicted in FIG. 5, also including a breech plug which is utilized in embodiments of the invention.

FIGS. 5-7 show a second embodiment 200 of the invention which system further comprises a breech plug 208 (not shown in FIGS. 5-7 but shown in FIG. 8). This embodiment of the firearm maintenance system 200 comprises a pump 202, a muzzle seal 204 and may comprise an optional barrel tube 206.

Figure 8A:
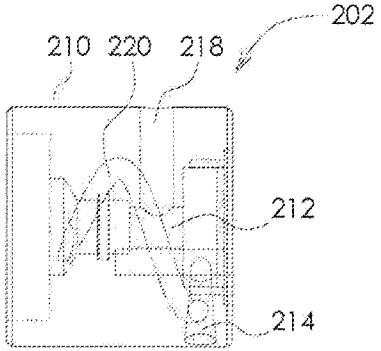
FIG. 8A depicts a detailed view of the structure encircled in FIG. 8.

FIGS. 8 and 8A show an exploded view of second embodiment 200 of the invention being used in conjunction with a breech plug 208 in relative position with a barrel 10 of a firearm, the barrel having a breech end 12 and a muzzle end 14. As further shown in FIG. 8 and FIG. 8A, pump 202 may comprise a housing 210 having a suction side 212 and a discharge side 214. Pump 202 may further comprise an impeller 216. Flow from discharge side 214 flows into outlet conduit 220. A squeeze bottle, syringe, or other maintenance fluid reservoir may be connected to a connection at inlet valve 236 to provide access for an initial flow of maintenance fluid into the inlet conduit 218. Once a charge of maintenance fluid has been placed into the firearm maintenance system, inlet valve 236 may be closed thereafter forming a closed system. Maintenance fluid may be discharged from discharge side 214 through outlet valve 238.

Outlet conduit 220 provides flow to barrel plug 222 which has flow channels (or conduits) 232. Barrel plug 222 extends into muzzle seal 204. A forward end 242 of barrel plug extends into the muzzle of barrel 10, where flow channels 232 extend through to the forward end 242. Barrel plug 222 has a rearward end having a flange 244 which may, but not necessarily, abut against the muzzle. Flange 244 may have an O-ring groove 246 to provide for sealing within pump body 210. Barrel plug 222 provides a flow of maintenance fluid into barrel 10. The maintenance fluid flows to breech plug 208 which prevents flow of the maintenance fluid past the breech end 12 of the barrel 10.

As depicted in some figures including FIGS. 8 and 8A, a barrel tube 206 may be utilized with some embodiments of the system. If used, an end of barrel tube 206 extends through an opening 240 of barrel plug 222, with the end disposed adjacent suction side 212. Flow channels 232 of barrel plug 222 are disposed around the exterior of barrel tube 206. When installed to a firearm, barrel tube 206 extends through barrel plug 222 into the barrel 10 of the firearm. Maintenance fluid flows through flow channels 232 and enters the annular space defined by the exterior of barrel tube 206 and the interior of barrel 10. The flow of maintenance fluid, blocked by breech plug 208, U-turns and enters the end of barrel tube 206 adjacent the breech plug. The maintenance fluid may be filtered by barrel tube filter 226 attached at the end of the barrel tube 206.

Figure 9:
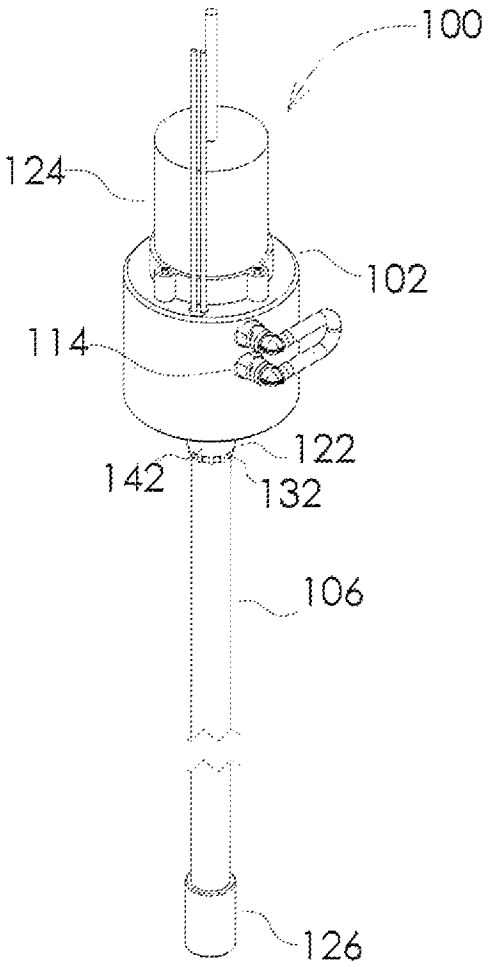
FIG. 9 depicts the embodiment of FIG. 1 but without showing the muzzle seal to better show the relationship of the barrel plug, pump, and barrel tube.
Figure 10:
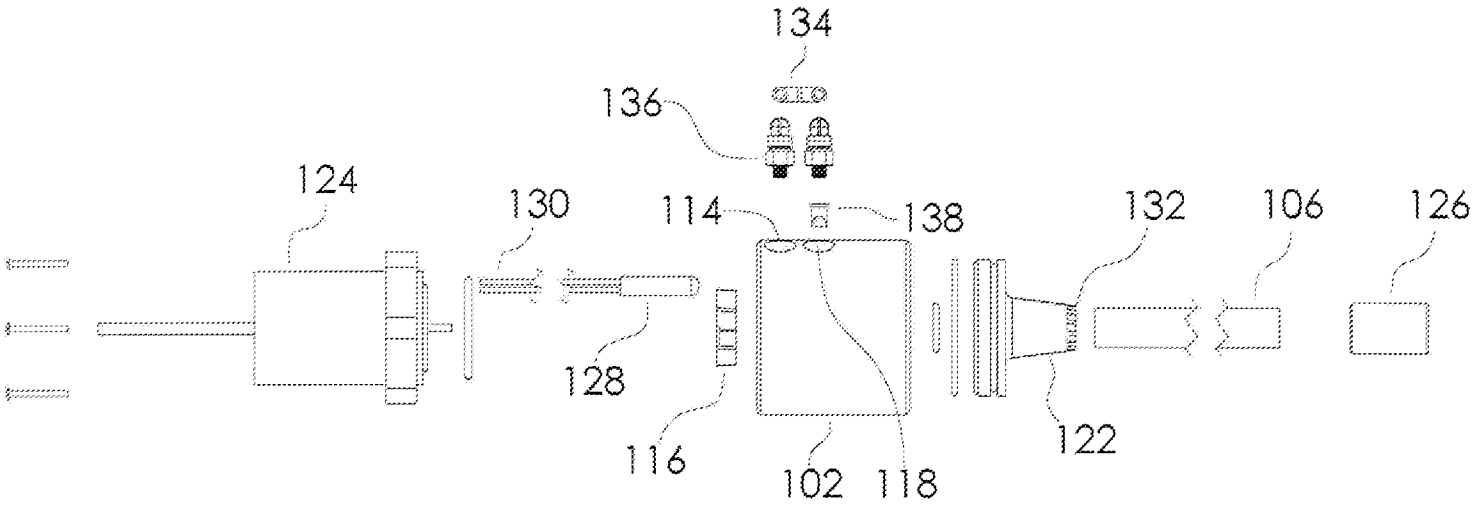
FIG. 10 depicts an exploded view of the assembly depicted in FIG. 9.

FIGS. 9-10 show an assembly of firearm maintenance system 100 except for breech plug 108 and muzzle seal 104 which, while not shown in the figures, are still utilized in this embodiment. Muzzle seal 104 is not shown to better illustrate the interaction of barrel plug 122 with pump 102 and optional barrel tube 106. FIGS. 9-10 depict pump 102, barrel plug 122, and barrel tube 106. Motor 124 may be attached to the rear of pump 102. A barrel tube filter 126 may be attached to the end of barrel tube 106 or other convenient hydraulic location for particulate filtration. If used, barrel tube 106 will extend into the barrel of the firearm with the end of the barrel tube disposed adjacent to the breech plug when the system has been attached to a firearm. Maintenance fluid will typically flow in the annulus formed between the exterior of the barrel tube 106 and the interior of the barrel 10 of the firearm with flow entering barrel tube filter 126 and returning to the pump inlet for either continued circulation in the barrel of the firearm or for discharge from the barrel of the firearm.

FIG. 10 shows an exploded view of the assembly of FIG. 9 of firearm maintenance system 100. System 100 has a pump 102 with an impeller 116. System 100 may further comprise an optional media heater 128 which may be a resistance-type heater having electrical leads 130 for providing heating to the maintenance fluid. Pump 102 is configured to discharge a flow of maintenance fluid through barrel plug 122 to the firearm. An optional barrel tube 106 may extend from barrel plug 122. Barrel plug 122 comprises flow channels (or conduits) 132 which direct flow around the exterior of barrel tube 106 for delivery into the barrel of a firearm. System 100 may further comprise sight tube 134 which attaches to swivel tube fittings 136. A check valve 138 may be disposed at inlet 118. Sight tube 134 allows the user to verify that there is fluid flow from outlet 114, though other sighting devices like sight glasses may be employed.

Figure 11:
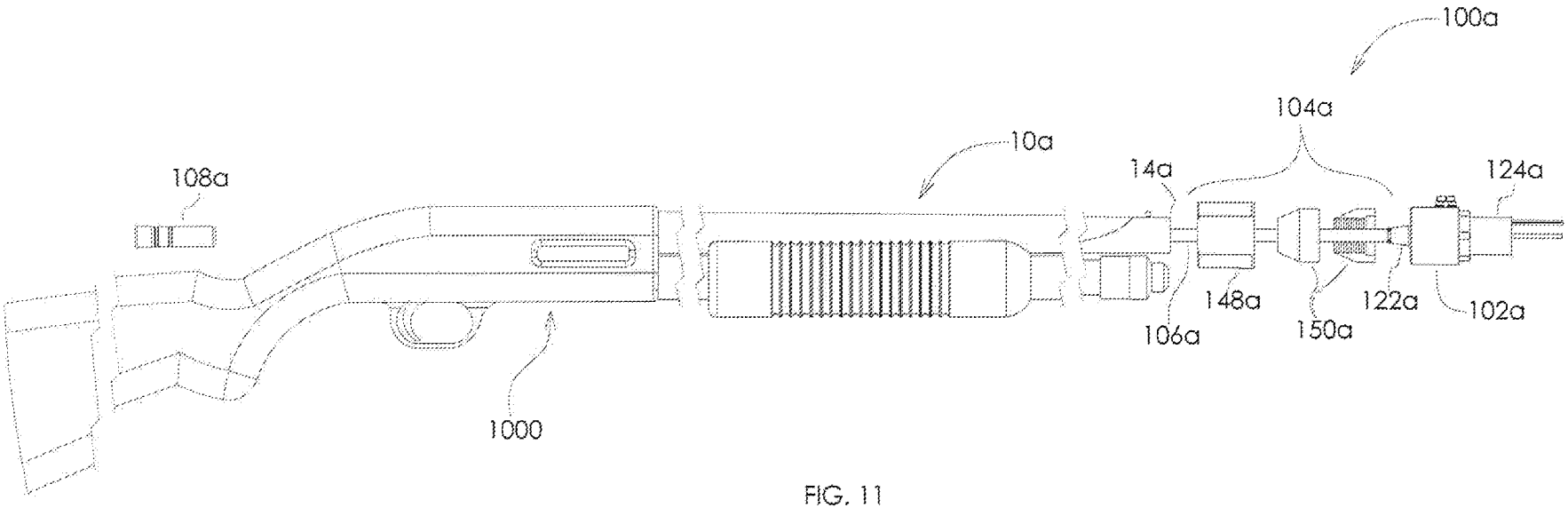
FIG. 11 depicts an embodiment of the invention in preparation for attachment to the barrel of a pump action shotgun, showing the relative placement of the different components of the system.
Figure 12:
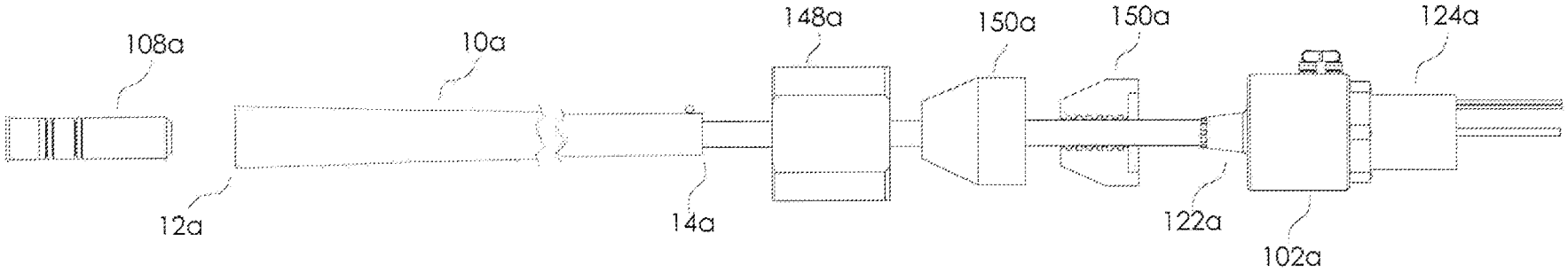
FIG. 12 schematically depicts the attachment of an embodiment of the firearm maintenance system to the barrel of a shotgun.

FIG. 11 depicts system 100*a* in anticipation of being used to clean a pump action shotgun 1000. It is to be appreciated that a pump action shotgun may be cleaned with the barrel removed as shown in FIG. 12, where a cork plug is utilized to seal the breach end of the barrel. However, it is possible, to install the breech plug 108*a* into the breech end of the shotgun barrel by "loading" the breech plug into the shotgun as if it were a shotgun shell. The firearm action will hold the breech plug in place and keep the breech plug from backing out under pressure. The other components of the system 100*a* are attached from the muzzle end 14*a* of the barrel 10*a*. FIG. 11 shows these components—the pump 102*a*, the muzzle seal 104*a*, the barrel tube 106*a*, and the barrel plug 122*a* spaced linearly apart from one another. However, when these components are attached to the shotgun 1000, the components will appear as shown in FIGS. 1 and 2, with barrel tube 106*a* inserted within barrel 10*a* with muzzle seal 104*a* secured over muzzle end 14*a* of barrel 10*a*.

FIG. 11 shows the internal components of muzzle seal 104*a* withdrawn from seal housing 148*a*, the internal components being muzzle seal grommet 150*a*. FIG. 11 depicts a two-piece split configuration for muzzle seal grommet 150*a*, although it is to be appreciated that a single piece grommet configuration may also be utilized. The muzzle seal grommets 150*a* work to squeeze the end of the barrel and clear the sights or other protuberances as the pump 102*a* is threaded into the muzzle seal 104*a*.

FIG. 11 also shows the use of a barrel plug 122*a* which may be utilized for firearms having a large bore barrel, such as for shotguns and large caliber rifles. However, barrel plug 122*a* may be used for all calibers not having a muzzle device or where it will properly seal.

Figure 13:
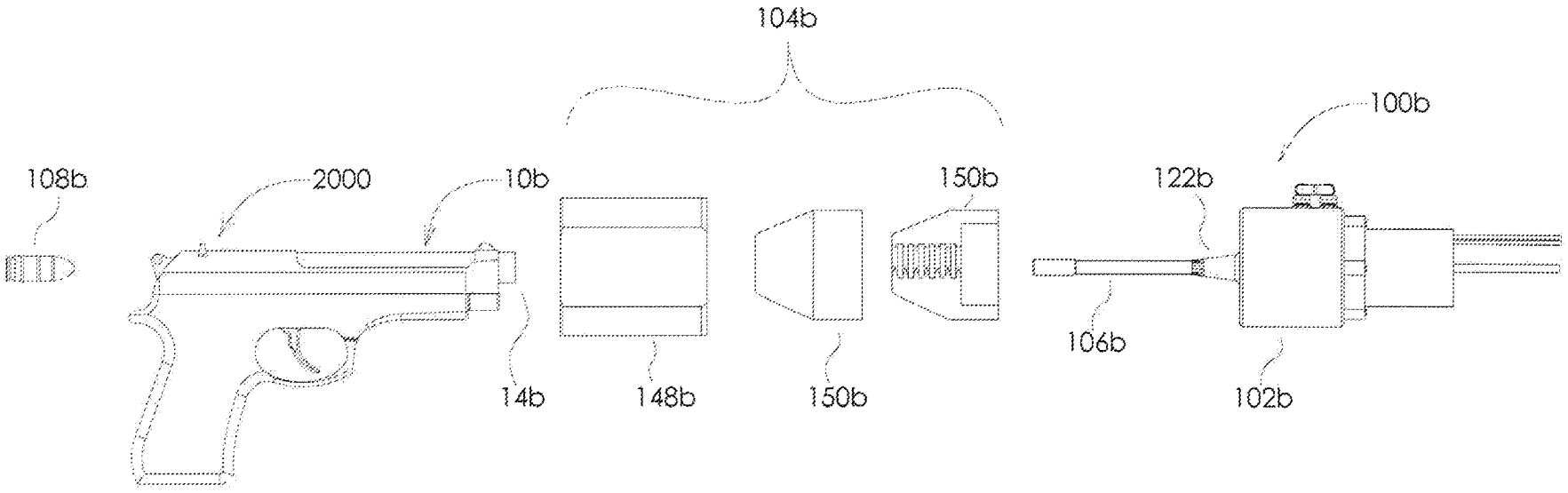
FIG. 13 depicts an embodiment of the invention which may be installed on a handgun, showing the relative placement of the different components of the system.

FIG. 13 depicts system 100*b* in anticipation of being used to clean a handgun 2000. It is to be appreciated that semi-automatic handguns may be cleaned with the barrel removed, although it is possible to install the breech plug 108*b* into the breech end of the handgun barrel as if it were a handgun bullet. The other components of the system 100*b* are attached from the muzzle end 14*b* of the barrel 10*b*. FIG. 12 shows these components—the pump 102*b*, the muzzle seal 104*b*, the barrel tube 106*b*, and the barrel plug 122*b* spaced linearly apart from one another. However, when these components are attached to the handgun 2000, the components will appear as shown in FIGS. 1 and 2, with barrel tube 106*b* inserted within barrel 10*b* with barrel seal 104*b* secured over muzzle end 14*b* of barrel 10*b*.

FIG. 13 shows the internal components of muzzle seal 104*b* withdrawn from seal housing 148*b*, the internal components being muzzle seal grommet 150*b*. FIG. 12 depicts a two-piece split configuration for muzzle seal grommet 150*b* although it is to be appreciated that a single piece grommet configuration may also be utilized. The muzzle seal grommets 150*b* work to squeeze the end of the barrel and clear the sights or other protuberances as the pump 102*b* is threaded into the muzzle seal 104*b*.

FIG. 13 also show the use of a barrel plug 122*b* which may be utilized for small caliber firearms, such as pistols (e.g., 9 mm, 10 mm, 45 auto, etc.).

Figure 14:
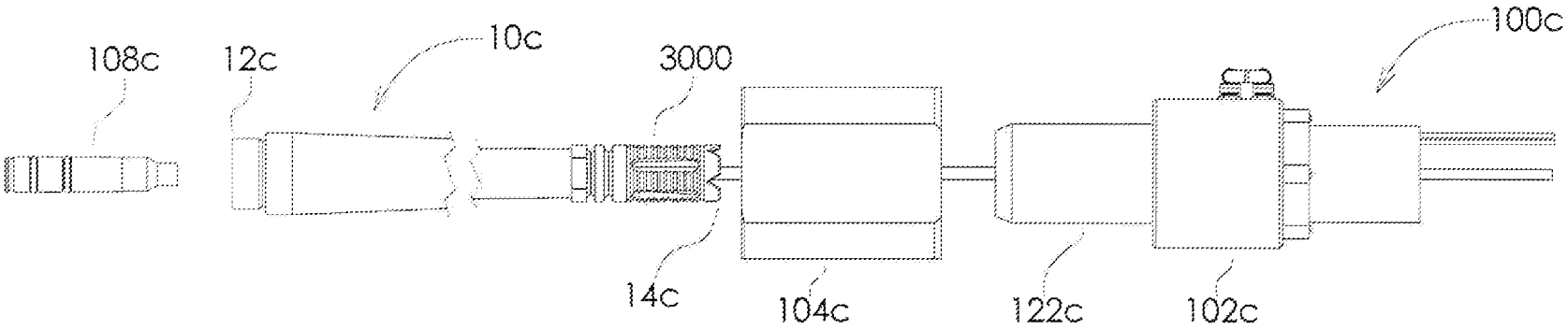
FIG. 14 schematically depicts the attachment of an embodiment of the firearm maintenance system to a firearm having a muzzle device, such as a flash hider or muzzle brake.
Figure 15:
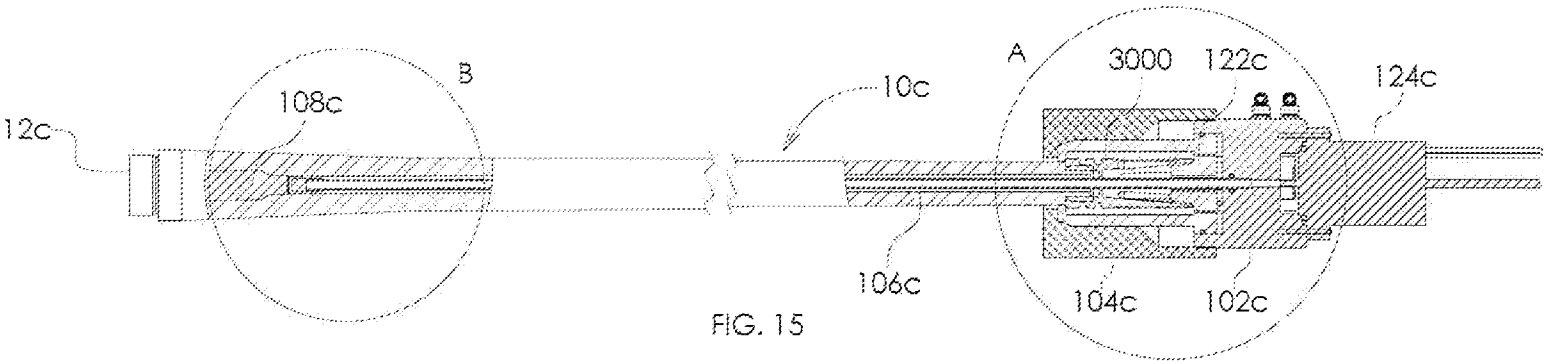
FIG. 15 schematically depicts the attachment of an embodiment of the firearm maintenance system to a firearm having a muzzle device, such as a flash hider or muzzle brake.
Figure 15A:
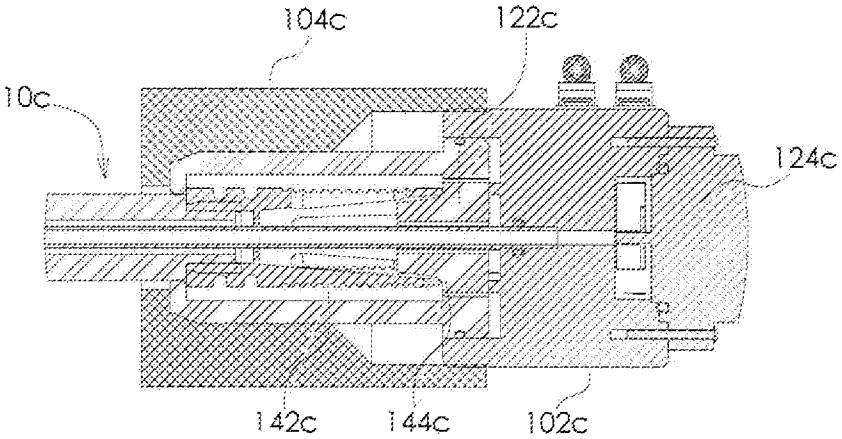
FIG. 15A depicts a detailed view of structure encircled in circle A of FIG. 15.
Figure 15B:
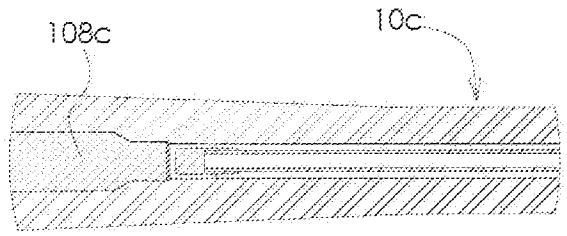
FIG. 15B depicts a detailed view of structure encircled in circle B of FIG. 15.

FIG. 14 depict system 100*c* in anticipation of being used to clean a barrel 10*c* of a firearm having a muzzle device 3000. FIGS. 15, 15A and 15B depict system 100*c* as installed on a barrel 10*c* of a firearm having a muzzle device 3000. System 100*c* is used with breech plug 108*c* inserted into breech end 12*c* of barrel 10*c*. The other components of the system 100*c* are attached from the muzzle end 14*c* of the barrel 10*c*, these components being the pump 102*c*, muzzle seal 104*c*, barrel tube 106*c*, and a special barrel plug 122*c*. Barrel plug 122*c* is made of either a one piece or two-piece design. Barrel plug 122*c* is configured to clamp or wrap, stretch and seal over the muzzle device 3000.

Figure 16:
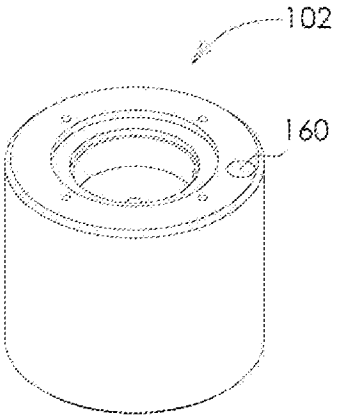
FIG. 16 shows a perspective view of an embodiment of a pump utilized in the present invention.

FIGS. 16-21 depict an embodiment of a pump 102 which may be utilized in embodiments of the firearm maintenance system 100. FIG. 16 shows a perspective view of the pump 102. Media heater 128, not shown, may be installed into pump 102 by insertion into aperture 160.

Figure 17:
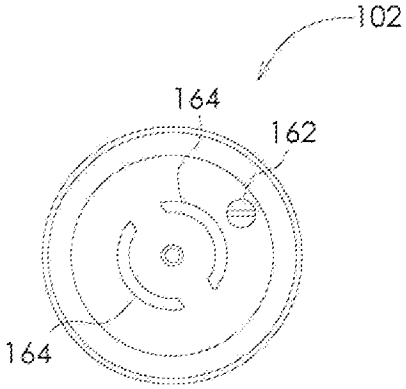
FIG. 17 shows a bottom view of the embodiment of the pump depicted in FIG. 16.

FIG. 17 shows a bottom view of pump 102 showing pump outlet 162. Barriers 164 redirect outlet flow from pump 102 to ensure concentric flow to the barrel 10 and/or muzzle device.

Figure 19:
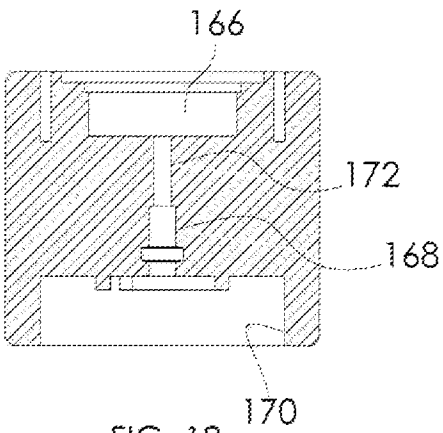
FIG. 19 shows a sectional view taken along line 19-19 of FIG. 18.
Figure 18:
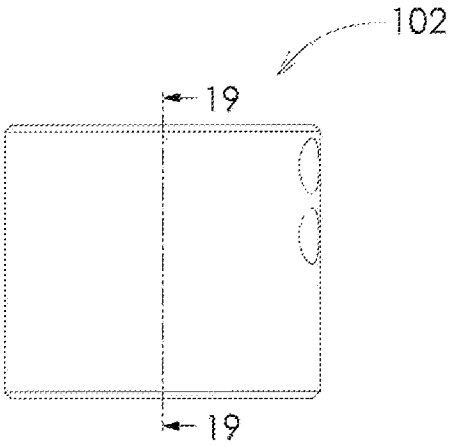
FIG. 18 depicts a first side view of the embodiment of the pump depicted in FIG. 16.

FIG. 18 shows a first side view of pump 102 with FIG. 19 showing a sectional view taken along line 19-19 of FIG. 18. FIG. 19 shows the shroud 166 where impeller 116 is disposed. FIG. 19 also shows receptacle 168 where barrel tube 106 may be received in pump 102. FIG. 19 also shows sealing surface 170 which seals against flange 144 of barrel plug 122. Pump inlet channel 172 receives flow from barrel tube 106 to the impeller low pressure zone.

Figure 21:
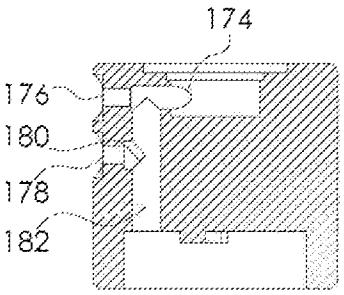
FIG. 21 shows a sectional view taken along line 21-21 of FIG. 20.
Figure 20:
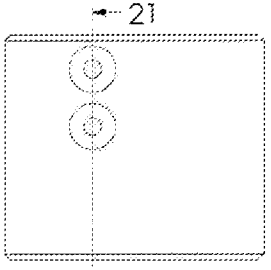
FIG. 20 depicts a second side view of the embodiment of the pump depicted in FIG. 16.

FIG. 20 shows a second side view of pump 102 with FIG. 21 showing a sectional view taken along line 20-20 of FIG. 20. FIG. 21 shows pump outlet 174. Also shown is aperture 176. Aperture 176 provides an air vent during inflow of maintenance fluid through aperture 178. Aperture 176 also provides a port for swivel tube fitting 136 to which sight tube 134 is attached. Aperture 178 provides a flow path for maintenance fluid. A check valve seat 180 is set within aperture 178 for seating check valve 138. Aperture 178 also provides a port for a second swivel tube fitting 136. Flow channel 182 provides the conduit for flow of maintenance fluid to the barrel plug 122.

Figure 22:
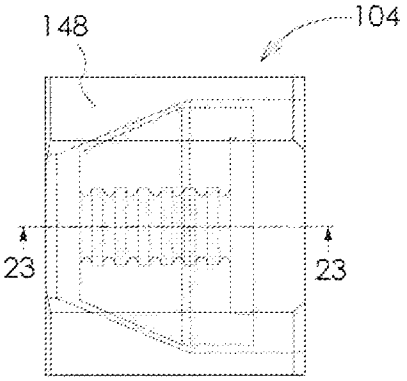
FIG. 22 shows a side view of an embodiment of a muzzle seal for use on a firearm with a "bare" barrel configuration (i.e., a barrel without muzzle device or exterior protuberances).
Figure 23:
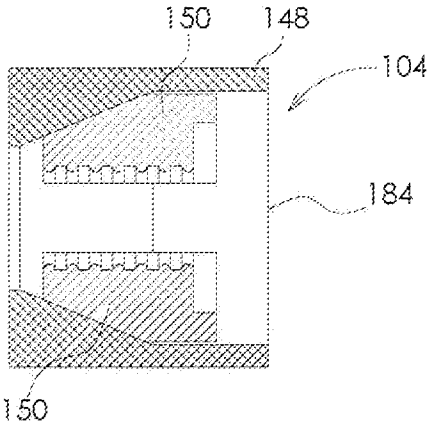
FIG. 23 shows a sectional view taken along line 23-23 of FIG. 22.

FIG. 22 shows a side view of an embodiment of a muzzle seal 104 for use on a firearm with a "bare" barrel configuration (i.e., a barrel without muzzle device or exterior protuberances). Muzzle seal 104 has a muzzle seal housing 148. FIG. 23 shows a sectional view taken along line 23-23 of FIG. 22. Pump 102 may comprise an end having external threads which may be threaded into end 184 of muzzle seal housing 148 having internal threads (not shown). As pump 102 is threaded into the muzzle seal housing 148, it comes into contact with the ends of muzzle seal grommets 150. Further rotation of pump into the muzzle seal housing 148 urges muzzle seal grommets 150 toward the front of the muzzle seal 104 along the interaction surface where the internal diameter of the muzzle seal housing 148 is reduced, causing the muzzle seal grommets 150 to squeeze tighter against barrel 10. Seal grommets 150 may comprise a ribbed profile which enhances the grip of the grommets against barrel 10. Muzzle seal grommets 150 define an internal diameter which allows clearance for iron sights on the barrel 10.

Figure 24:
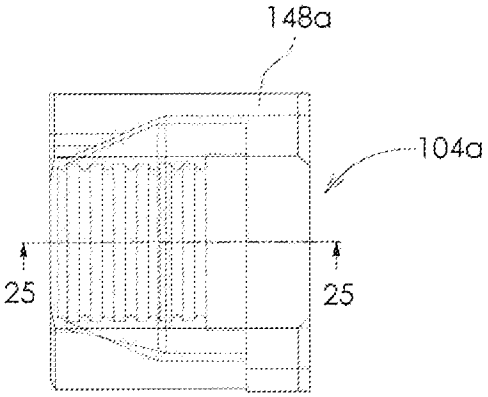
FIG. 24 shows a side view of an embodiment of a muzzle seal for use on a pump shotgun.
Figure 25:
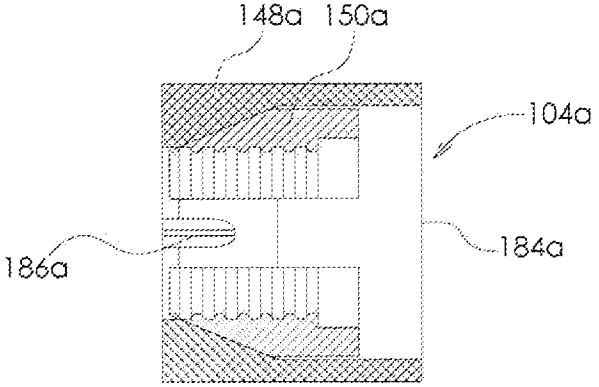
FIG. 25 shows a sectional view taken along line 25-25 of FIG. 24.

FIG. 24 shows a side view of an embodiment of a muzzle seal 104*a* for use on a shotgun. Muzzle seal 104*a* has a muzzle seal housing 148*a*. FIG. 25 shows a sectional view taken along line 25-25 of FIG. 24. Pump 102*a* may comprise an end having external threads which may be threaded into end 184*a* of muzzle seal housing 148*a* having internal threads (not shown). As pump 102*a* is threaded into the muzzle seal housing 148*a*, it comes into contact with the ends of muzzle seal grommets 150*a*. Further rotation of pump 102*a* into the muzzle seal housing 148*a* urges muzzle seal grommets 150*a* toward the front of the muzzle seal 104*a* along the interaction surface where the internal diameter of the muzzle seal housing 148*a* is reduced, causing the muzzle seal grommets 150*a* to squeeze tighter against barrel 10*a*. Seal grommets 150*a* may comprise a ribbed profile which enhances the grip of the grommets against barrel 10*a*. A relief 186*a* is provided in muzzle seal 104*a* to provide clearance for iron sights or other protuberances on the shotgun barrel 10*a*.

Figure 26:
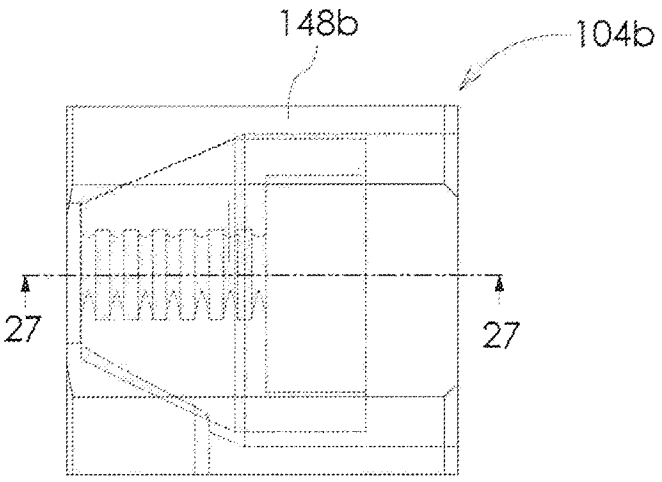
FIG. 26 shows a side view of an embodiment of a muzzle seal for use on a pistol.
Figure 27:
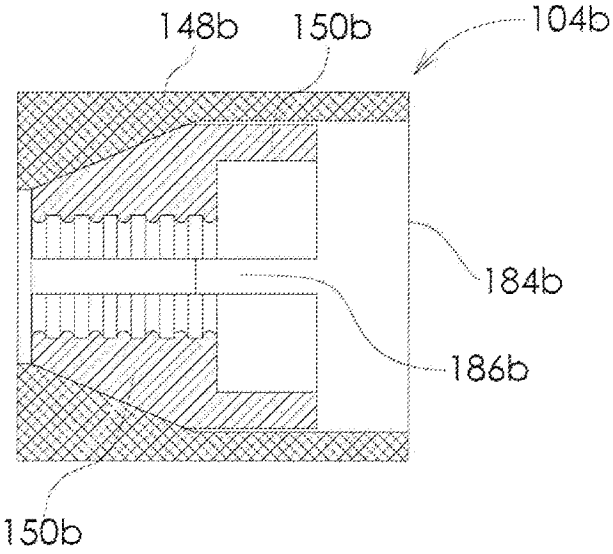
FIG. 27 shows a sectional view along line 27-27 of FIG. 26.

FIG. 26 shows a side view of an embodiment of a muzzle seal 104*b* for use on a pistol. Muzzle seal 104*b* has a muzzle seal housing 148*b*. FIG. 27 shows a sectional view taken along line 27-27 of FIG. 26. Pump 102*b* may comprise an end having external threads which may be threaded into end 184*b* of muzzle seal housing 148*b* having internal threads (not shown). As pump 102*b* is threaded into the muzzle seal housing 148*b*, it comes into contact with the ends of muzzle seal grommets 150*b*. Further rotation of pump 102*b* into the muzzle seal housing 148*b* urges muzzle seal grommets 150*b* toward the front of the muzzle seal 104*b* along the interaction surface where the internal diameter of the muzzle seal housing 148*b* is reduced, causing the muzzle seal grommets 150*b* to squeeze tighter against barrel 10*b*. Seal grommets 150*b* may comprise a ribbed profile which enhances the grip of the grommets against barrel 10*b*. A clearance channel 186*b* is provided in muzzle seal 104*b* to provide clearance for iron sights or other protuberances on the handgun 10*b*.

Figure 28:
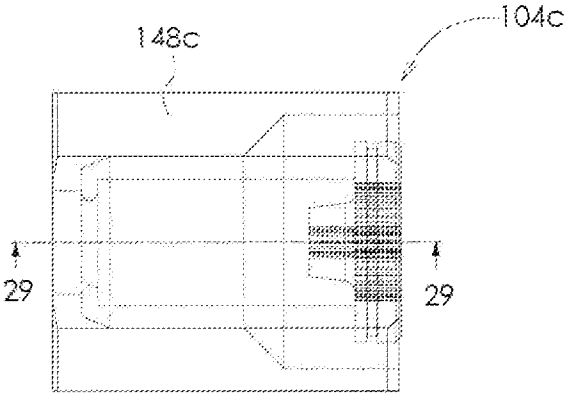
FIG. 28 shows a side view of an embodiment of a muzzle seal for use on a firearm having a muzzle device.
Figure 29:
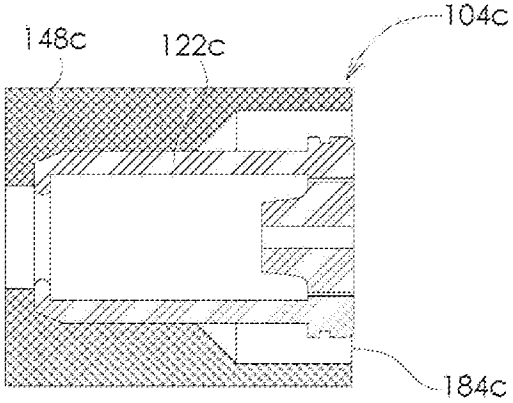
FIG. 29 shows a sectional view taken along line 29-29 of FIG. 28.
Figure 30:
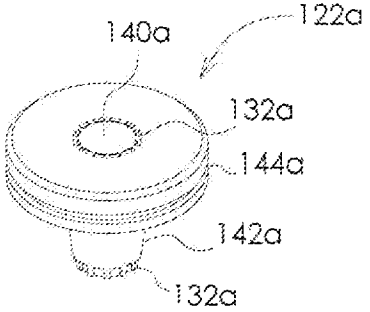
FIG. 30 shows a perspective view of an embodiment of a barrel plug utilized in embodiments of the invention for use on large caliber firearms.
Figure 31:
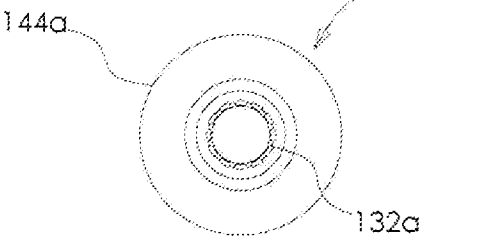
FIG. 31 shows a bottom end view of the barrel plug of FIG. 30.
Figure 33:
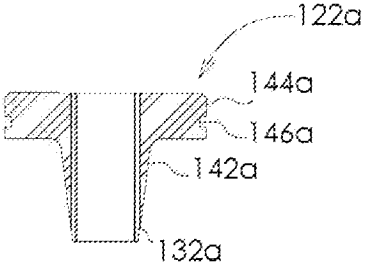
FIG. 33 is a sectional view along line 33-33 of FIG. 32.
Figure 32:
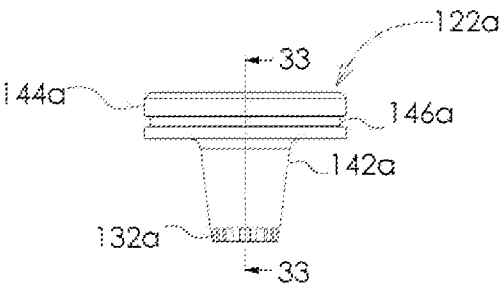
FIG. 32 shows a side view of the barrel plug of FIG. 30.
Figure 34:
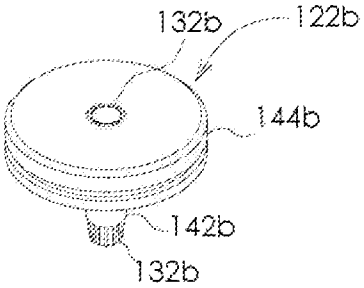
FIG. 34 shows a perspective view of an embodiment of a barrel plug utilized in embodiments of the invention for use on small caliber firearms.
Figure 35:
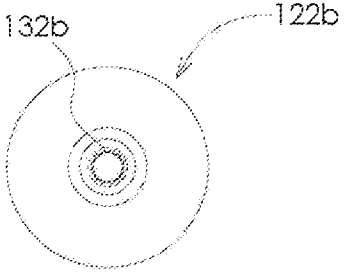
FIG. 35 shows a bottom end view of the barrel plug of FIG. 34.
Figure 37:
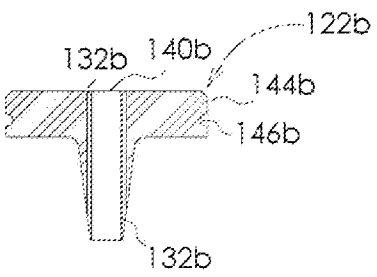
FIG. 37 is a sectional view along line 37-37 of FIG. 36.
Figure 36:
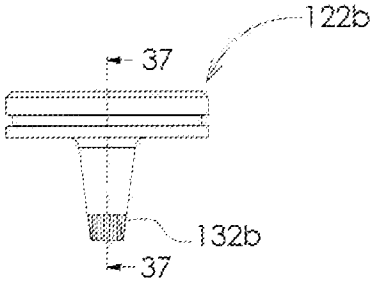
FIG. 36 shows a side view of the barrel plug of FIG. 34.

FIG. 28 shows a side view of an embodiment of a muzzle seal 104*c* for use on a firearm having a muzzle device. Muzzle seal 104*c* has a muzzle seal housing 148*c*. FIG. 29 shows a sectional view taken along line 29-29 of FIG. 28. Pump 102*c* may comprise an end having external threads which may be threaded into end 184*c* of muzzle seal housing 148*c* having internal threads (not shown). As pump 102*c* is threaded into the muzzle seal housing 148*c*, it squeezes the material of the barrel plug 122*c* causing the barrel plug to conform to the shape over the muzzle device 3000. As discussed above, barrel plug 122*c* is made of either a one piece or two-piece design and is composed of a material which is configured to clamp or wrap, stretch and seal over the muzzle device 3000, such as an elastomeric material.

FIGS. 30-41 depict barrel plugs 122*a*-122*c* which may be utilized for different firearm calibers and configurations.

FIGS. 30-33 depict an embodiment of a barrel plug 122*a* which may be utilized with a large caliber firearm. Barrel plug 122*a* has a plurality of flow channels 132*a* which are disposed in a radial pattern in about the exterior of a barrel plug 122*a* as exemplified in FIGS. 30-33. Barrel plug 122*a* has an opening 140*a* which axially extends through the body of the barrel plug from forward end 142*a* to flange 144*a*. Flange 144*a* may have an O-ring groove 146*a*.

FIGS. 34-37 depict an embodiment of a barrel plug 122*b* which may be utilized with small caliber firearms. Barrel plug 122*b* has a plurality of flow channels 132*b* which are disposed in a radial pattern in about the exterior of a barrel plug 122*b* as exemplified in FIGS. 34-37. Barrel plug 122*b* has an opening 140*b* which axially extends through the body of the barrel plug from forward end 142*b* to flange 144*b*. Flange 144*b* may have an O-ring groove 146*b*.

Figure 38:
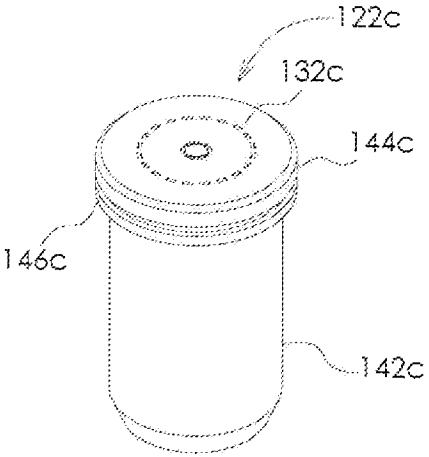
FIG. 38 shows a perspective view of an embodiment of a barrel plug utilized in embodiments of the invention for use on firearms with muzzle devices, such as flash hiders or muzzle brakes.
Figure 41:
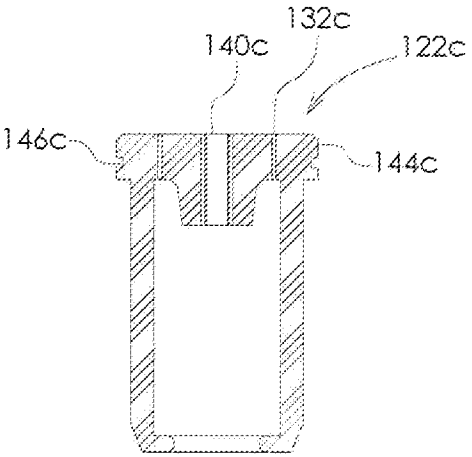
FIG. 41 is a sectional view along line 41-41 of FIG. 40.
Figure 40:
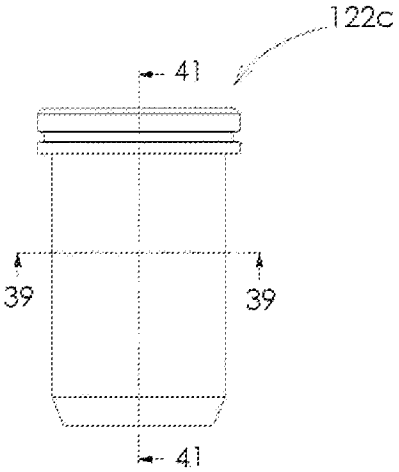
FIG. 40 shows a side view of the barrel plug of FIG. 38.
Figure 39:
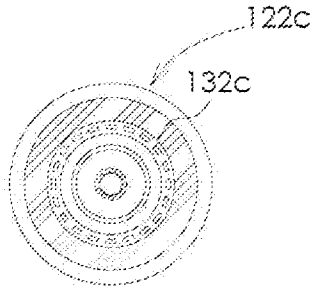
FIG. 39 shows a bottom end view of the barrel plug of FIG. 38.

FIGS. 38-41 depict an embodiment of a barrel plug 122*c* which may be utilized with a firearm having a muzzle device 3000. Barrel plug 122*c* has a plurality of flow channels 132*c* which are disposed in a radial pattern about an exterior end of barrel plug 122*c* as shown in FIG. 38 which extend through the upper end to an interior surface as shown in FIG. 41. Barrel plug 122*c* has an opening 140*c* which axially extends through the upper portion of the barrel plug. Barrel plug 122*c* has an upper flange 144*c* which may have an O-ring groove 146*c*.

Having thus described the preferred embodiment of the invention, what is claimed as new and desired to be protected by Letters Patent includes the following:

The invention claimed is:

1. A system for maintaining a firearm, the firearm comprising a barrel having a breech end and a muzzle end, the system comprising:

a breech plug configured to fit within and form a liquid tight seal with the breech end of the barrel;

a muzzle seal configured to fit and form a liquid tight seal with the muzzle end of the barrel;

a pump comprising a housing having a suction side and a pressure side, the suction side comprising an inlet conduit and the pressure side comprising an outlet conduit configured to provide a flow of a maintenance fluid into the barrel; and a barrel tube having a first end adjacent to the pump inlet and a second end configured to be inserted into the barrel and placed adjacent to the breech plug.

2. The system of claim 1 wherein the muzzle seal clamps around an exterior end of the barrel.

3. The system of claim 2 wherein the muzzle seal comprises a housing having a barrel attachment end, a pump housing attachment end, and an intermediate section, the housing comprising an internal profile which has a decreasing diameter between the intermediate section and the barrel attachment end.

4. The system of claim 3 wherein the muzzle seal further comprises a grommet disposed within the housing, where the grommet is configured to squeeze around the barrel as the grommet is urged toward the barrel attachment end.

5. The system of claim 4 wherein the pump housing attachment end of the muzzle seal is configured to engage a pump housing containing the pump wherein the engagement of the pump housing to the pump housing attachment end of the muzzle seal urges the grommet toward the barrel attachment end causing the grommet to seal tighter around the barrel.

6. The system of claim 1 comprising a barrel plug disposed within the muzzle seal, the barrel plug comprising a forward end which is configured to be inserted in the muzzle end of the barrel.

7. The system of claim 1 wherein the flow of a maintenance fluid is directed through a fluid heater before flowing into the barrel.

8. The system of claim 1 further comprising an ultrasonic generator configured to induce cavitation in the maintenance fluid in the barrel.

9. A system for maintaining a firearm, the firearm comprising a barrel having a breech end and a muzzle end, the system comprising:

a breech plug configured to fit within and form a liquid tight seal with the breech end of the barrel;

a muzzle seal configured to fit and form a liquid tight seal with the muzzle end of the barrel;

a pump housing comprising a first end configured to sealingly attach to the muzzle seal and a second end configured to attach to a motor housing;

an impeller disposed within the pump housing, the pump housing comprising a suction side and a pressure side, the suction side comprising an inlet conduit and the pressure side comprising an outlet conduit;

a motor disposed within the motor housing, the motor having a shaft attached to the impeller; and a tube having a first end and a second end, the first end configured to be received within the pump housing and disposed adjacent to the inlet conduit and the second end configured to be inserted within the barrel of the firearm and disposed adjacent to the breech plug, wherein the outlet conduit is hydraulically connected to an annulus defined between an exterior of the tube and an interior of the barrel.

10. The system of claim 9 comprising a fluid heater.

11. The system of claim 9 wherein a first valve is attached to the inlet conduit.

12. The system of claim 9 wherein a second valve is attached to the outlet conduit.

13. A method of maintaining a firearm, the firearm comprising a barrel having a breech end and a muzzle end, the method comprising:

inserting a breech plug within the breech end of the barrel resulting in a liquid tight seal between the plug and the breech end of the barrel;

attaching a muzzle seal to the muzzle end of the barrel resulting in a liquid tight seal with the muzzle seal and the muzzle end of the barrel;

heating a maintenance fluid;

pumping the maintenance fluid through a conduit seal into the barrel resulting in a flow of maintenance fluid in the barrel;

and receiving a return flow of maintenance fluid from the barrel.

14. The method of claim 13 wherein the muzzle seal clamps around an exterior end of the barrel.

15. The method of claim 13 wherein the muzzle seal is inserted into an end of the barrel.

16. The method of claim 13 including the step of inducing cavitation in the maintenance fluid in the barrel.

17. A system for maintaining a firearm, the firearm comprising a barrel having a breech end and a muzzle end, the system comprising:

a breech plug configured to fit within and form a liquid tight seal with the breech end of the barrel;

a muzzle seal configured to fit and form a liquid tight seal with the muzzle end of the barrel; and a pump comprising a housing having a suction side and a pressure side, the suction side comprising an inlet conduit and the pressure side comprising an outlet conduit configured to provide a flow of a maintenance fluid into the barrel; and a fluid heater through which the maintenance fluid flows before flowing into the barrel.

18. A system for maintaining a firearm, the firearm comprising a barrel having a breech end and a muzzle end, the system comprising:

a breech plug configured to fit within and form a liquid tight seal with the breech end of the barrel;

a muzzle seal configured to fit and form a liquid tight seal with the muzzle end of the barrel, wherein the muzzle seal clamps around an exterior end of the barrel, wherein the muzzle seal comprises a housing having a barrel attachment end, a pump housing attachment end, and an intermediate section, the housing comprising an internal profile which has a decreasing diameter between the intermediate section and the barrel attachment end; and a pump comprising a housing having a suction side and a pressure side, the suction side comprising an inlet conduit and the pressure side comprising an outlet conduit configured to provide a flow of a maintenance fluid into the barrel.

* * * * *